United States Patent [19]

Beuscher

[11] Patent Number: 4,598,018

[45] Date of Patent: Jul. 1, 1986

[54] INSULATING HIGH TEMPERATURE WIRE

[75] Inventor: Clinton J. Beuscher, Sturbridge, Mass.

[73] Assignee: Galileo Electro-Optics Corp., Sturbridge, Mass.

[21] Appl. No.: 652,341

[22] Filed: Sep. 19, 1984

Related U.S. Application Data

[63] Continuation of Ser. No. 541,555, Oct. 13, 1983, abandoned, which is a continuation of Ser. No. 361,827, Mar. 25, 1982, abandoned.

[51] Int. Cl.[4] ..... B32B 15/00; H01B 7/00

[52] U.S. Cl. ..... 428/389; 428/365; 428/375; 428/379; 174/124 R; 174/124 G

[58] Field of Search ..... 428/375, 377, 379, 389, 428/384, 365; 174/124 GC, 126 SR, 120 C, 121 SR, 122 R, 122 G, 122 C, 124 R, 124 G; 156/51, 52, 53; 427/120, 119; 501/95

[56] References Cited

U.S. PATENT DOCUMENTS

| | | | |
|---|---|---|---|
| 2,169,097 | 8/1939 | Hall et al. | 174/124 GC |
| 2,187,401 | 1/1940 | Potter | 174/124 GC |
| 2,227,931 | 1/1941 | Greenleaf | 174/124 GC |
| 2,475,083 | 7/1949 | Davis | 174/124 GC |
| 2,808,338 | 10/1957 | Bruno et al. | 501/95 X |
| 4,201,247 | 5/1980 | Shannon | 428/288 X |

FOREIGN PATENT DOCUMENTS

| | | | |
|---|---|---|---|
| 1287402 | 8/1972 | United Kingdom | 501/95 |

*Primary Examiner*—Lorraine T. Kendell

[57] ABSTRACT

An electrical wire for use in high temperature applications made by providing refractory fibers that are larger than one micron in diameter and made of nonmetallic mineral material that has a melting point greater than 1200° F., and applying the fibers and a binder to an electrically conductive core, to form an insulating coating around the core.

6 Claims, 1 Drawing Figure

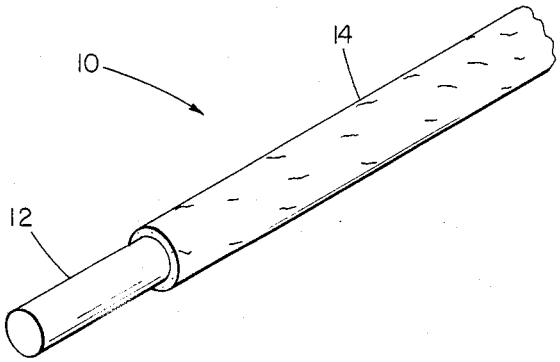
10
14
12

INSULATING HIGH TEMPERATURE WIRE

This application is a continuation of application Ser. No. 541,555, filed Oct. 13, 1983, now abandoned, which is a continuation of application Ser. No. 361,827, filed Mar. 25, 1982, now abandoned.

FIELD OF THE INVENTION

The invention relates to electrical wires for use in high temperature applications.

BACKGROUND OF THE INVENTION

Insulation for electrical wires exposed to high temperatures is typically made from asbestos fibers, which have diameters between 200 and 1000 angstroms. With recent concern about the health problems associated with exposure to asbestos, attention has been directed to replacing asbestos with other materials.

SUMMARY OF THE INVENTION

In general the invention features a heat-resistant electrical wire made by providing refractory fibers that are larger than one micron in diameter and made of nonmetallic mineral material that has a melting point greater than 1200° F. and applying the fibers and a binder to an electrically conductive core to form an insulating coating around the core.

In the preferred method of making the heat-resistant electrical wire, glass fibers and carrier fibers that are longer and more flexible than the glass and refractory fibers are mixed with the refractory fibers to hold them in place prior to applying the fibers and the binder to the core; the binder is a liquid that is curable to a semirigid state after the binder and fibers have been applied to the core; the binder is heat curable, and the coated core is heated; the carrier fibers are cellulosic; the binder is polymerizable and partially polymerizes during the heating of the coated core; the fibers are first applied to the core, and then the core and fibers are immersed in a bath of the binder; the carrier fibers and glass fibers are first mixed together to result in a homogeneous mixture, and then this mixture is mixed with the refractory fibers; the fibers and binder on the core are compacted after the binder has been applied; the compacting is accomplished by passing the coated core through a converging passageway of a rotating die; the fibers are carded and wrapped around the core prior to being immmersed in the binder; the coated fibers are immersed in the binder and compacted twice prior to curing of the binder; the glass fibers are greater than 1½ inches long, and the carrier fibers are between 4 and 8 inches long; the refractory fibers are made of rockwool or material including alumina and silica. In some preferred embodiments the refractory fibers are mixed with the mixed carrier and glass fibers by placing them in an overhead hopper of the carding machine, and in some other preferred embodiments the fibers are mixed in a picker prior to entering the carding machine.

In use, the binder keeps the refractory fibers and the glass fibers in place during handling and incorporation of the wire into apparatus subjected to high temperatures. When the heat resistant wires are subjected to temperatures above 500° to 700° F. the binder burns off, and at temperatures above 1000° to 1200° F., the glass fibers melt and flow and hold the refractory fibers in place. With continued exposure to high temperatures, the glass fibers begin to disintegrate leaving behind the refractory fibers.

DESCRIPTION OF THE PREFERRED EMBODIMENT

I turn now to description of the structure, manufacture, and use of the presently preferred embodiment of the invention, after first briefly describing the drawing, which is a perspective view, partially broken away, of an electrical wire according to the invention.

STRUCTURE

Referring to the drawing, there is shown electrical wire 10 for use in high temperature applications. It has 50 mil thick electrically conductive nickel core 12, and 10 mil thick insulating coating 14, resulting in a 70 mil diameter. Prior to being subjected to high temperatures in use, coating 14 includes refractory fibers up to ½ inch in length and 2½ microns in diameter and made of nonmetallic mineral material (40.4% alumina, 50.6% silica, 3.6% magnesia, 4.5% calcium, 1.8% alkalis; bulk form; available from Johns Manville under the trade designation 1600), glass fibers (about 1½ to 1¾ inches long, and 2½ to 4 microns in diameter and available from Owens Corning, and semirigid silicone binder (available from Dow Corning under the trade designation 996 Varnish) between the fibers and wire core 12.

MANUFACTURE

The manufacture of wire 10 involves mixing the refractory fibers and the glass fibers with cellulosic carrier fibers (to hold the glass and the refractory fibers in place during manufacture), applying the fibers to core 12 with a polymerizable binder, and then heating the core with the fibers and the binder to burn off the cellulosic fibers and cure the binder to a semirigid state.

First, equal amounts of glass fibers and carrier fibers (rayon fibers 4 inches to 8 inches in length and 3 to 4 microns in diameter) are mixed together to form a fluffy homogeneous mixture of the two types of fibers by a method described in U.S. Pat. Nos. 3,727,270 and 3,793,629. The carrier fibers are longer and more flexible than the glass and refractory fibers. If the glass fibers are much shorter than 1½ inches, the tendency to curl can be a problem, and if they are much longer than 1¾ inches, there may be problems later in the process in the carding operation. The homogeneous mixture is mixed with an equal volume of refractory fibers (the homogeneous mixture, which is 10% by weight of the total fiber content, has the same volume as the refractory fibers, which are 90% by weight of the total) in a standard textile picker to form a mat ⅛ to ¼ inch thick. The refractory fibers desirably do not have much shot, i.e., globular portions on the elongated fibers, to facilitate processing.

Applying the mixed fibers and the binder to the core is done by carding the fibers in a carding machine (Davis Furber sample card designed for asbestos carding) to align the fibers, feeding core 12 to the funnel-shaped fiber sliver leaving the carding machine, and immersing the fibers and core 10 in a bath of the binder. The fibers are passed through the carding machine twice—a first time without core 12 after the doffer roller to result in a fluffy mat ½ to 1 inch thick and 3 inches wide (this can be rolled up and stored or used immediately), and a second time with core 12 after the doffer roller to wrap the fibers on core 12. The fibers are curled with a diameter of 3 to 4 inches as they are directed from the doffer roller by the comb, and core 12 is fed into the curled fibers at between 10 and 15 feet per minute. In wrapping the curled fibers around core 12, the fibers are drawn to a funnel shape 3 inches long with a diameter at the smaller end of 125 to 150 mils as they rotate about core 12 and are pulled by it. Core 12 and the rotating fibers are fed into a rotating die with a passageway converging to an 88 mil diameter orifice. The rotating die is about 1½ inches long and rotates in the same direction as the fibers. The longer and more flexible carrier fibers hold the refractory fibers and the glass fibers, which have more memory than the carrier fibers, in place during this part of the manufacturing process. The fibers are generally spirally positioned on core 12. The core with the wrapped fibers are immersed in a first bath of silicone binder and then passed through a second rotating die having an orifice with a diameter of about 80 mils. The second rotating die squeezes the excess binder out of the fiber coating and further compacts the fiber coating. The coated core is then immersed in a second silicone bath, to fill in the surface dimples of the coating. The coated core then passes through two more rotating dies with 75 mil diameter orifices to complete the applying of the fibers and binder to the wire core.

The coated core then passes into an oven with three stepped zones to bring the heat up to 475° F., and one zone to bring it down again to room temperature. In the oven, the cellulosic fibers are burned off, and the silicone binder is partially polymerized so that it is semi-rigid.

After emerging from the oven, the coated wire, which has a somewhat gummy coating, passes through a rotating polishing die with a 75 mil diameter orifice, to provide a smooth surface, and through a second final rotating die with a 70 mil diameter orifice, to provide the correct final diameter. The wire can then be rolled into convenient lengths for storage, and can be provided with other coverings, such as tape made from synthetic fluorine containing resins (e.g., Teflon), as desired prior to usage.

USE

In use, appropriate lengths of wire 10 are cut and incorporated into apparatus subjected to high temperatures, e.g., aircraft. The polymerized binder keeps the refractory fibers and glass fibers in place during storage and assembly. Coating 14 provides electrical insulation for electrically conductive core 12. When the wire is subjected to hot temperatures, the binder burns off and the glass fibers hold the refractory fibers in place. At temperatures above 1000° to 1200° F., the glass fibers melt and flow and hold the refractory fibers in place. With continued exposure to high temperatures, the glass fibers eventually disintegrate, leaving just the refractory fibers in place. Wire 10 can withstand 2000° F. for at least five minutes.

OTHER EMBODIMENTS

Other embodiments of the invention are within the scope of the appended claims. For example only, a few are mentioned.

The above described use of a picker to mix the fibers and passage of the fibers through the carder a first time to obtain a fluffy mat can be avoided by adding the homogeneous mixture of the glass and carrier fibers to the overhead hopper of a carding machine with the refractory fibers, the appropriate mixing and conditioning of all fibers taking place in the overhead hopper. Other material can be used for the refractory fibers so long as it has a melting point greater than about 1200° F. and the fibers are similar in size, e.g., preferably between 1 and 6 microns in diameter. Examples of such refractory materials are rockwool and ceramics such as 2400 from Combustion Engineering (48 to 50% alumina, 49.5 to 51% silica in bulk form) or A-2600 from Babcock and Wilcox (54% alumina, 45% silica in bulk form). Other binders such as Tefzel (available from DuPont) can be used, and other carrier fibers, e.g., synthetic plastic fibers or cellulosic fibers such as cotton, can be used instead of rayon fibers. Also, the fibers could be formed into a tape, which is then wrapped onto the electrical core by a taping machine.

What is claimed is:

1. An electrical wire for use in high temperature applications, said wire comprising an electrically conductive core, and an insulating coating of a carded mixture comprising refractory fibers that are larger than one micron in diameter and made of essentially nonmetallic mineral material that has a melting point greater than about 1200° F. and holding fibers that are longer than the refractory fibers and are sufficiently long to hold the refractory fibers in place at elevated temperatures and are made of a material that has a lower melting point than said refractory fibers.

2. The wire of claim 1 wherein said holding fibers are glass fibers.

3. The wire of claim 2 wherein said coating further comprises a binder with said refractory fibers and glass fibers, said binder comprising material that burns off at a temperature lower than the melting point of said glass fibers.

4. The wire of claim 2 wherein said coating further comprises carrier fibers that are longer and more flexible than said glass fibers and refractory fibers.

5. The wire of claim 4 wherein said coating further comprises a binder.

6. The wire of claim 1 wherein said nonmetallic mineral material comprises alumina and silica.

* * * * *